US005125858A

United States Patent [19]

Salvetti

[11] Patent Number: 5,125,858

[45] Date of Patent: Jun. 30, 1992

[54] RETRACTABLE PROPULSOR FOR BOATS

[76] Inventor: Mauro Salvetti, Via Gramsci, 4, 06065 Passignano sul Trasimeno (PG), Italy

[21] Appl. No.: 477,830

[22] PCT Filed: Sep. 23, 1988

[86] PCT No.: PCT/IT88/00064

§ 371 Date: May 21, 1990

§ 102(e) Date: May 21, 1990

[87] PCT Pub. No.: WO89/03341

PCT Pub. Date: Apr. 20, 1989

[30] Foreign Application Priority Data

Oct. 15, 1987 [IT] Italy ..... 22297 A/87

[51] Int. Cl.[5] ..... B63H 5/12

[52] U.S. Cl. ..... 440/54; 440/49

[58] Field of Search ..... 440/49, 53, 54, 58-63

[56] References Cited

U.S. PATENT DOCUMENTS

| | | | |
|---|---|---|---|
| 1,124,645 | 1/1915 | Overton | 440/54 |
| 2,156,938 | 5/1939 | Edwards | 440/54 |
| 2,466,635 | 4/1949 | Brown et al. | 440/54 |
| 2,545,086 | 3/1951 | Harris | 440/54 |
| 2,885,990 | 5/1959 | Hawthorne | 440/54 |
| 2,987,027 | 6/1961 | Wanzer | 440/54 |
| 3,030,910 | 4/1962 | Alsager | 440/54 |
| 3,076,428 | 2/1963 | Shipley | 440/54 |
| 3,483,843 | 12/1969 | Hawthorne | 440/54 |
| 3,587,512 | 6/1971 | Patterson | 440/54 |
| 3,685,481 | 8/1972 | Mansell | 440/54 |
| 3,807,347 | 4/1974 | Baldwin | 440/54 |
| 4,175,511 | 11/1979 | Krautkremer | 440/54 |
| 4,274,827 | 6/1981 | Catsburg | 440/54 |
| 4,573,929 | 3/1986 | Savikurki | 440/54 |

FOREIGN PATENT DOCUMENTS

| | | | |
|---|---|---|---|
| 1039874 | 9/1958 | Fed. Rep. of Germany | 440/54 |
| 2229608 | 12/1974 | France | 440/54 |
| 638507 | 12/1978 | U.S.S.R. . | |
| 991704 | 5/1965 | United Kingdom . | |
| 1054916 | 1/1967 | United Kingdom | 440/54 |

*Primary Examiner*—Joseph F. Peters, Jr.
*Assistant Examiner*—Clifford T. Bartz
*Attorney, Agent, or Firm*—Young & Thompson

[57] ABSTRACT

The propulsor comprises a main engine, a fixed tubular part, a main transmission which ends with a substantially vertical shaft which operates a bevel gear on the substantially vertical shaft which operates a bevel gear pair on the substantially horizontal outlet of which a propeller is placed, an auxiliary transmission which carries out the rotation around a vertical axis of the bottom end of the propeller, a moveable assembly which moves vertically with respect to the fixed structure of the boat and is integral in this direction with the bevel gear pair and with the propeller. It is characterized by the fact that said moveable group is made of an inner part which can rotate with respect to a vertical axis which rests vertically, on a moveable carriage, the lower end of which extends downwards at least to the level of a fixed support integral with the structure of the boat.

3 Claims, 15 Drawing Sheets

AE3
AC2
AE4
AE3
AD4
AE1
AC6
B1
B3
A1
BC2
A16
A15
B4
BD3
BC1
B4
BC9
BC7
BC6
BD15
BC8
A2
A3
A4
AE1
AD1
BD2
BD1
A5
A6
A1
B1
OL
A7
F
F
BC5
BD12
BD14
BD13
OL

A6
AE1
AE2
A5

RETRACTABLE PROPULSOR FOR BOATS

FIELD OF THE INVENTION

This invention concerns retractable propulsors for boats.

BACKGROUND OF THE INVENTION

Retractable propulsors for boats are known, for example, from the French patent No. 2.229.608.

This document describes an auxiliary propulsor in which the propeller is withdrawn into a cavity forseen under the hull. The propeller is fixed to a shaft which penetrates an upper hollow tube when the propeller is raised. The lifting is carried out by means of a hydraulic jack, one end of which is fast with to a fixed frame and the other to a horizontal plate placed under the propeller. For the rotation of the assembly telescopic elements are housed in another tube fixed to the craft on which the same rotate. The pressure oil contained in the transmission system is used for controlling the hydraulic jack and for rotating the driving shaft.

The main disadvantages which are noted in this embodiment are the lack of mechanical sturdiness, as well as the general kinematic complication due to the fact that the whole assembly must rotate, the possibility of using only hydraulic engines and on the whole the considerable size. Another disadvantage is that of finding the optimal application only on flat-bottomed boats.

OBJECTS OF THE INVENTION

The document DE-B-1 039 874 describes a propulsor unit for boats comprising: a main engine; a fixed tubular part; a main transmission which ends with a substantially vertical shaft which operates a bevel gear pair on the substantially horizontal outlet of which a propeller is placed; an auxiliary transmission which carries out the rotation around a vertical axis of the bottom end of the propeller; a movable assembly which moves vertically with respect to the fixed structure of the boat and is integral in this direction with the bevel gear pair and with the propeller. Said movable assembly is made of an inner part which can rotate with respect to a vertical axis which rests vertically on a movable carriage.

The disadvantage that is noted in said propulsor is that the transversal thrust generated by the propeller is supported by some elements of the hydraulic system, which may disturb their operation. A further disadvantage is that at least some of the elements of the hydraulic system come in contact with the external environment, therefore they may be fouled and consequently may function badly. Furthermore, said propulsor unit is remarkably bulky.

The main aim of this invention is to give the upmost stability to the moveable part bearing the propeller so that the horizontal thrust is well supported by the inner kinematic motion, acquiring on the whole a simple and compact construction.

A further aim is that of obtaining a shape of the hull of the boat as hydrodynamic as possible when the propeller is retracted.

SUMMARY OF THE INVENTION

The main aim is reached by a propulsor for boats as claimed in claim 1.

Preferably the tube is provided with a check tongue which, during its rotation, engages the full part of the tube discharging thereupon the horizontal component of the thrust of the propeller. This tube has a double function: it favours the centering of the carriage in the vertical movement and acts as a shelf when the assembly is in the functioning position, directly opposing the carriage (reverse gear) or the check tongue (forward gear).

Preferably the carriage is moved in a vertical direction by at least one fixed screw engaged with a nut screw integral to the carriage.

The carriage can be hydraulically moved by a piston concentric to the carriage. In such a case the main transmission shaft can be used as a piston. It is also possible to provide a toroidal piston which surrounds the transmission shaft, or else to sue the upper part of the carriage as a piston.

Preferably the power which rotates the propeller is transmitted to a lateral pinion which moves a crown integral with the main transmission shaft.

The pinion can have a horizontal axis and can be connected to a driving shaft with a horizontal axis.

The pinion can be hollow and capable of receiving the horizontal shaft only when the assembly is extracted, said shaft being provided with a front coupling.

Preferably an axial cavity is provided in the movable assembly which can allow the passage of engine exhaust fumes, in particular the crown gears can have holes to allow such a passage.

A preferred embodiment foresees that when the carriage moves vertically it is integral in this direction to the final transmission gears, said gears being internally hollow and sliding on fixed rotating shafts in a vertical direction, their external surfaces matching with said internal grooves of the gears.

BRIEF DESCRIPTION OF THE DRAWINGS

Exemplary embodiments of a propulsor according to this invention are illustrated in the attached drawings in which.

DETAILED DESCRIPTION OF THE INVENTION

Figure 14:
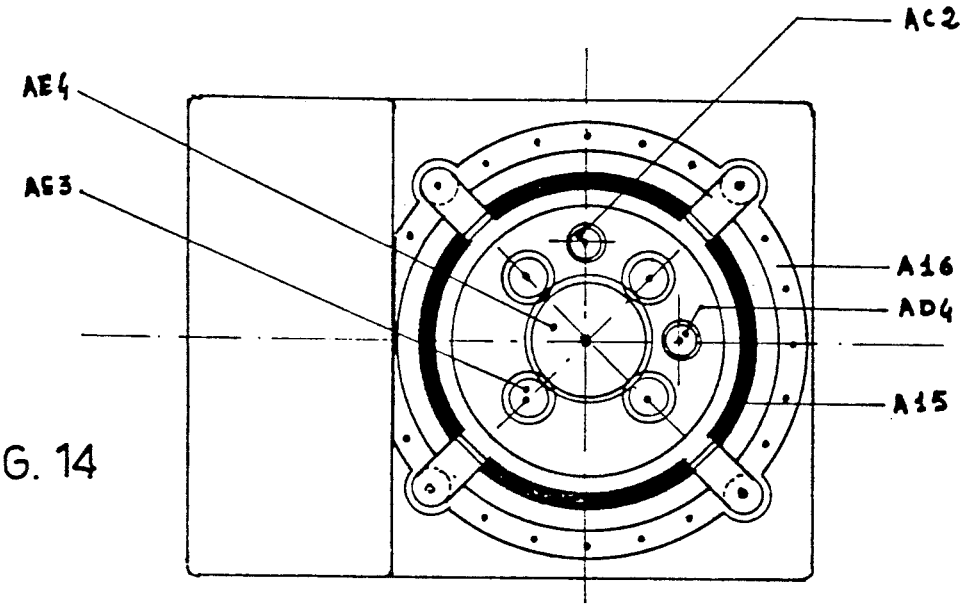
FIG. 14 shows a view from above of part of the assembly illustrated in FIG. 1.

In FIGS. 1, 2, 3 and 4 a sectioned hull of a boat is shown. To the hull a supporting box element A1 is integrally fixed and partly contained therein. The box element A1 supports and houses a propulsor comprising a cylindric element A2, provided with an air space A4 and an open tube A7 which extends said cylinder A2. Between a flange A6 of the tube A7 and a flange A5 of the element A2 a sealing gasket A15 is placed which extends until it reaches the space between the supporting element A1 and a flange A16 bolted to it. On the inside of the cylindrical element A2 a hollow body is provided, which acts as carriage B1, the upper end of which is next to the inner wall of the cylindrical element A2 by means of a guiding ring B3. In the cavity of the carriage B1 a hollow shaft BC1 is housed, surrounded by two bearings B4, the hollow shaft being integral to a crown gear BC2. Above the crown gear BC2 a second crown gear BD2 is placed integral to a transmission shaft BD3, placed inside the hollow shaft BC1, a gear wheel BD12 being integral to its opposite end. The gear wheel BD12 engages (by a bevel gear pair) with a gear wheel BD13 integral to a shaft BD14 which supports the end opposite a propeller BD15 surrounded by a tubing cylinder BC7, provided with an element BC8 which acts as a closing door for the retracted box element A1. A hollow body BC5 houses the bevel gear pair BD12-BD13 forming the bottom end of the propeller; said bottom end BC5 is provided with a check tongue BC9 and an inner of the cylindric element A2 four threaded bars AE1 are also placed, the upper end of which is provided with a gear AE3, while the lower end is provide with a cylindrical head AE2 fixed between the flange A5 of the element A2 and the flange A6 of the tube A7 (as can be seen in FIG. 15). Said threaded bars AE1 are engaged with threaded bushing integral to the carriage 31. The gears AE3 are engaged, as planet gears, with a solar gear AE4 (as can be seen from FIG. 14). The crown gear BD2 engages a hollow pinion BD1 keyed on a broached shaft AD1—placed inside the cylindric element A2—which is provided with a crown gear AD4 at its upper end (moved by an appropriate transmission: chain or belt, if it is a pulley: gear of a bevel gear pair or hydraulic engine directly mounted). The crown gear BC2 instead engages a hollow pinion BC13 keyed on a broached shaft AC6, placed inside the cylindric element A2, which at the upper end is provided with a crown gear AC2 (moved for example by worm screws or a hydraulically moved rack).

The propulsor previously described comprises fixed positioned parts which slide vertically, in order to allow the extension of the assembly (FIGS. 1 and 3) for engine sailing and the retraction (FIGS. 2 and 4) for wind sailing, and a rotating part, in order to allow the orientation of the propeller BD15 for choosing the direction in a field of 360°. The fixed part comprises: a box (not visible in the drawings) containing the gears for the raising and rotating, the cylindric element A2, the tube A7, the threaded bars AE1. The part which can be moved by sliding vertically comprises: the carriage B1 and the entire rotating part. The rotating part comprises: the hollow shaft BC1, the bottom end BC5 with the tongue BC9 and with all what is housed therein and the tubing cylinder BC7 with the propeller BD15.

When one wants to sail by using the engine, by pressing a button, the extension of the assembly can be obtained, so that the propeller BD15 reaches the suitable depth from the retracted position when it was contained in the hull, not disturbing the wind sailing. The gear AE4, to which a rotation is transmitted (in a prestablished direction), moves the gears AE3 which make the threaded bars AE1 rotate. These engage the threaded bushing integral to the carriage B1 obliging it to extend downwards taking the whole vertically sliding part with it. At this point the propeller BD15 is positioned at the right depth, but in the reverse gear direction; if one wants to go ahead it is necessary to carry out with the appropriate button, a rotation of 180° of the propeller BD15. By use of an appropriate transmission the crown AC2 is made to rotate; the rotation is transmitted by the shaft AC6, integral to the crown AC2, to the hollow pinion BC13, which in turn, engaging the crown BC2, rotates the hollow shaft BC1 and with it all the rotating part. In the propeller's BD15 new position, during the propulsion thrust (forward movement) the check torque BC9 engages the tube A7, while the tube A7, in reverse gear, acts as a shelf directly contrasting the carriage B1. A rotation of less than 180° can also be transmitted in any direction, this allowing the boat to be directed as steering. As far as the operation of the propeller is concerned: a rotation is transmitted to the crown gear AD4 which, by means of the broached shaft AD1, rotates the hollow pinion ED1, which, engaging the crown gear BD2, moves the transmission shaft BD3 and consequently, by means of the bevel gear pair BD12-BD13, the shaft BD14, therefore the propeller BD15.

If one then wants to sail by wind, in order to retract the propeller BD15, the assembly is made to operate in analogous way, but in an inversed sequence and with the gears rotating in the opposite way.

Figures 1, 15:
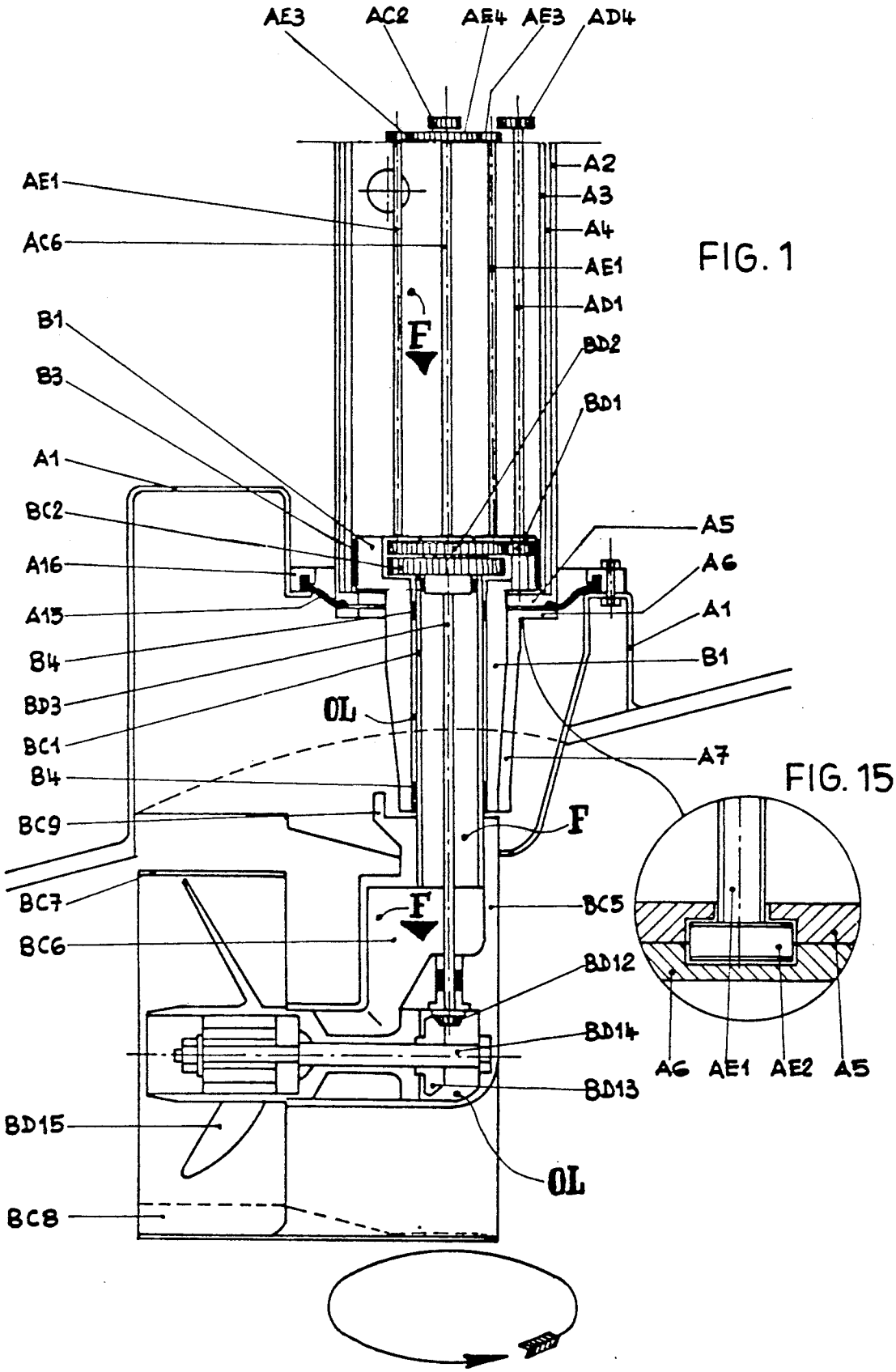
FIG. 1 shows a longitudinal sectional view of a propulsor with the movable part extended.
FIG. 15 shows a detail of FIG. 1.
Figure 2:
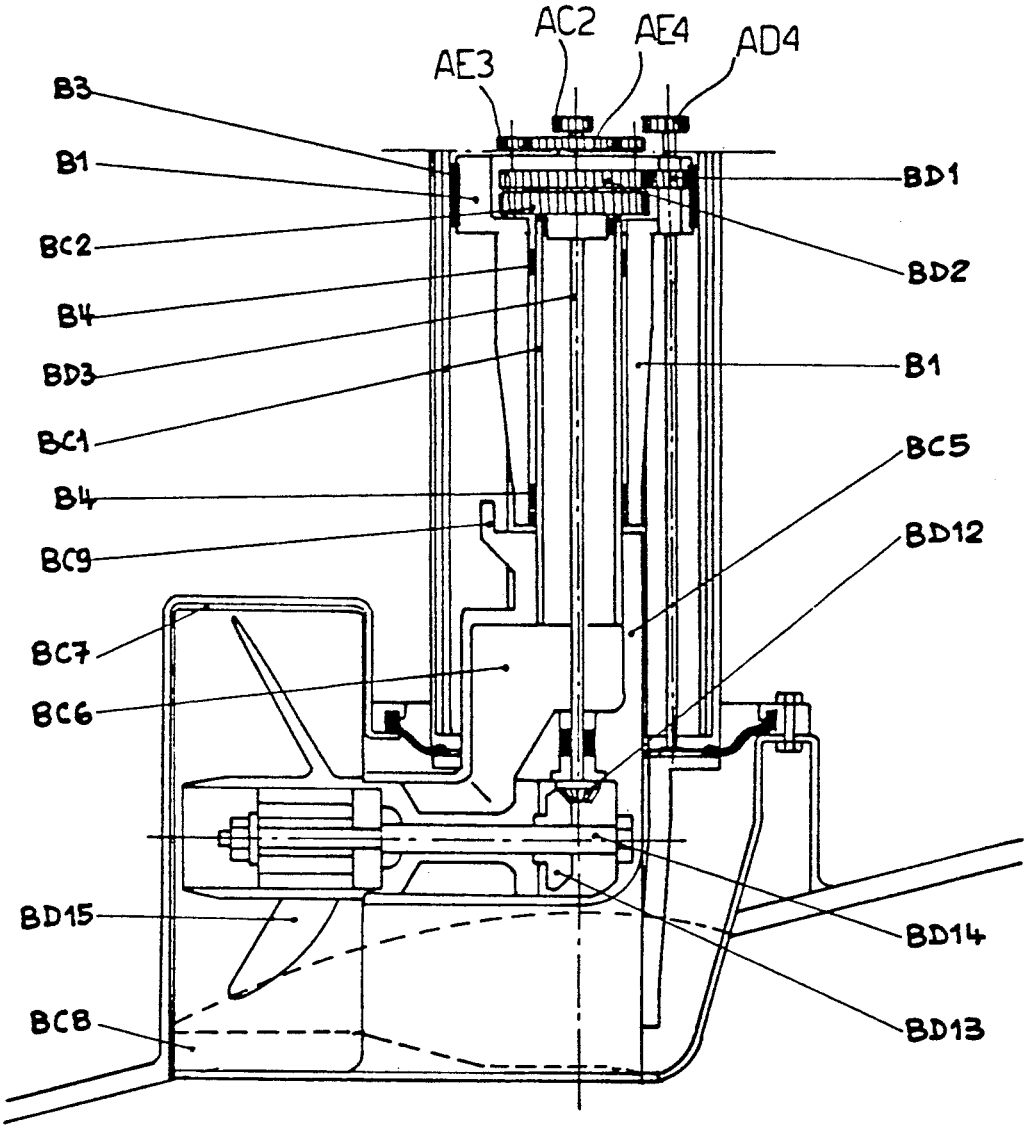
FIG. 2 shows a longitudinal sectional view of the assembly of FIG. 1 with the movable part retracted.
Figure 3:
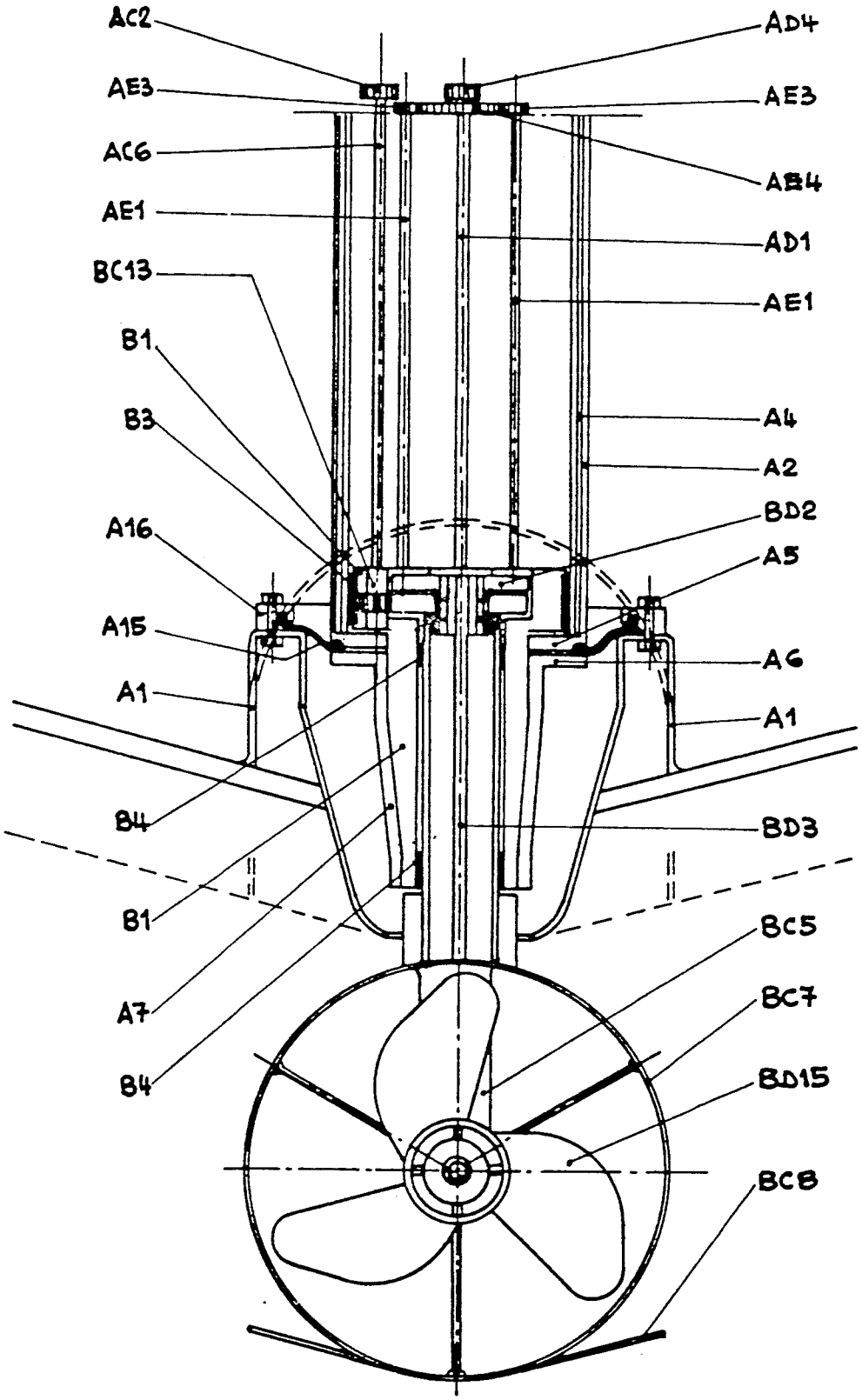
FIG. 3 shows a transversal sectional view of the assembly of FIG. 1.
Figure 4:
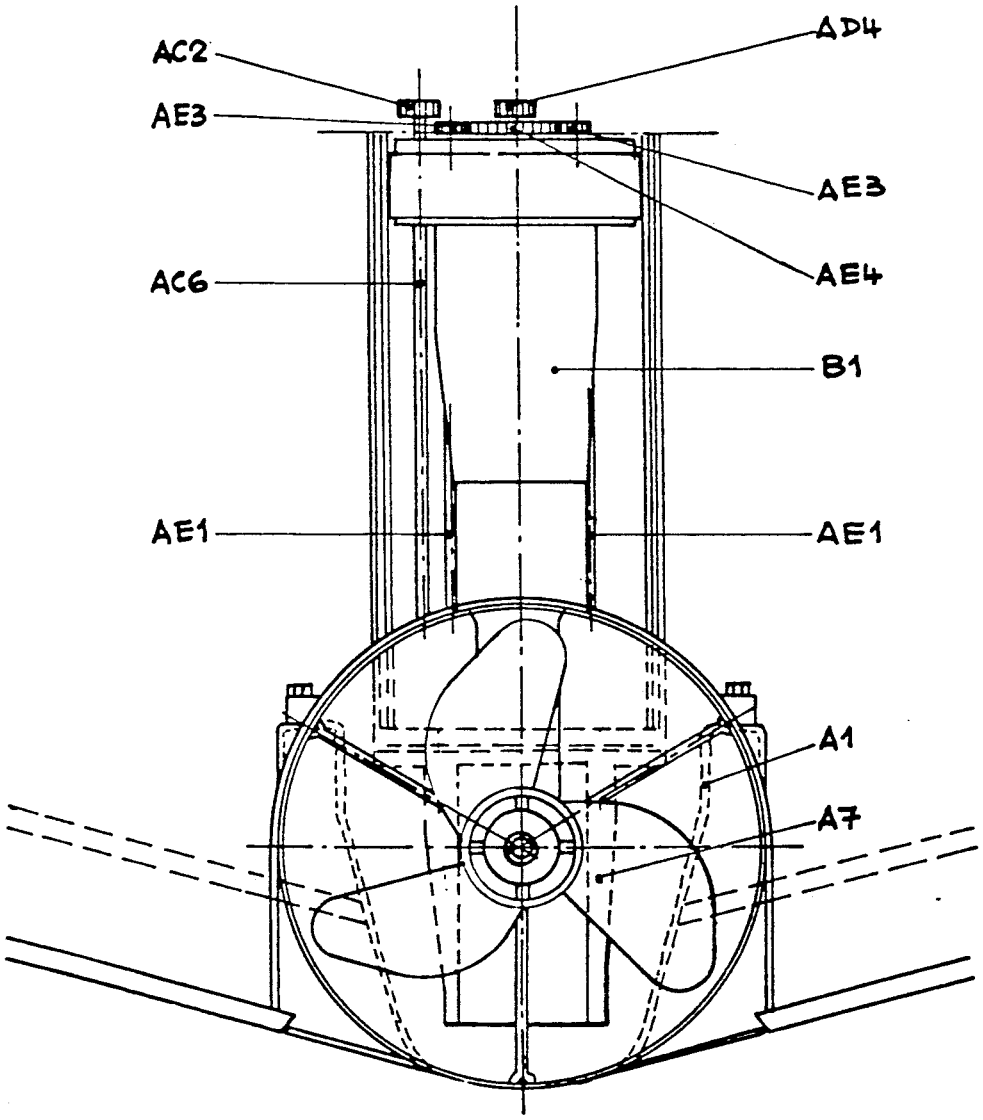
FIG. 4 shows a transversal sectional view of the assembly of FIG. 2.
Figure 5:
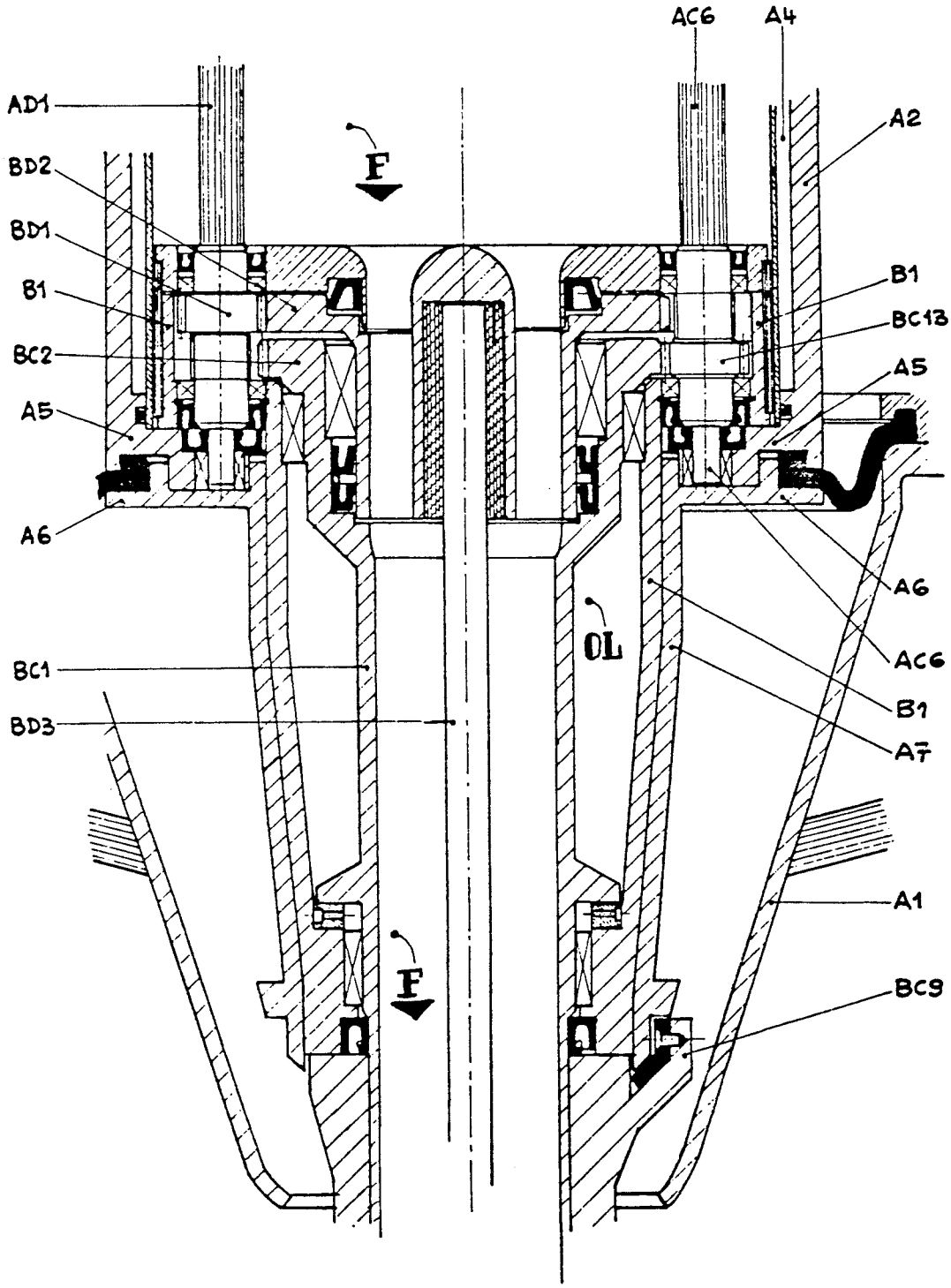
FIG. 5 shows an enlarged view of part of FIG. 3.

In FIG. 5 an enlargement of one part of the assembly previously described is shown. In this figure the shaft AC6 has been removed by 90° to allow its section on the transversal plane.

Figure 6:
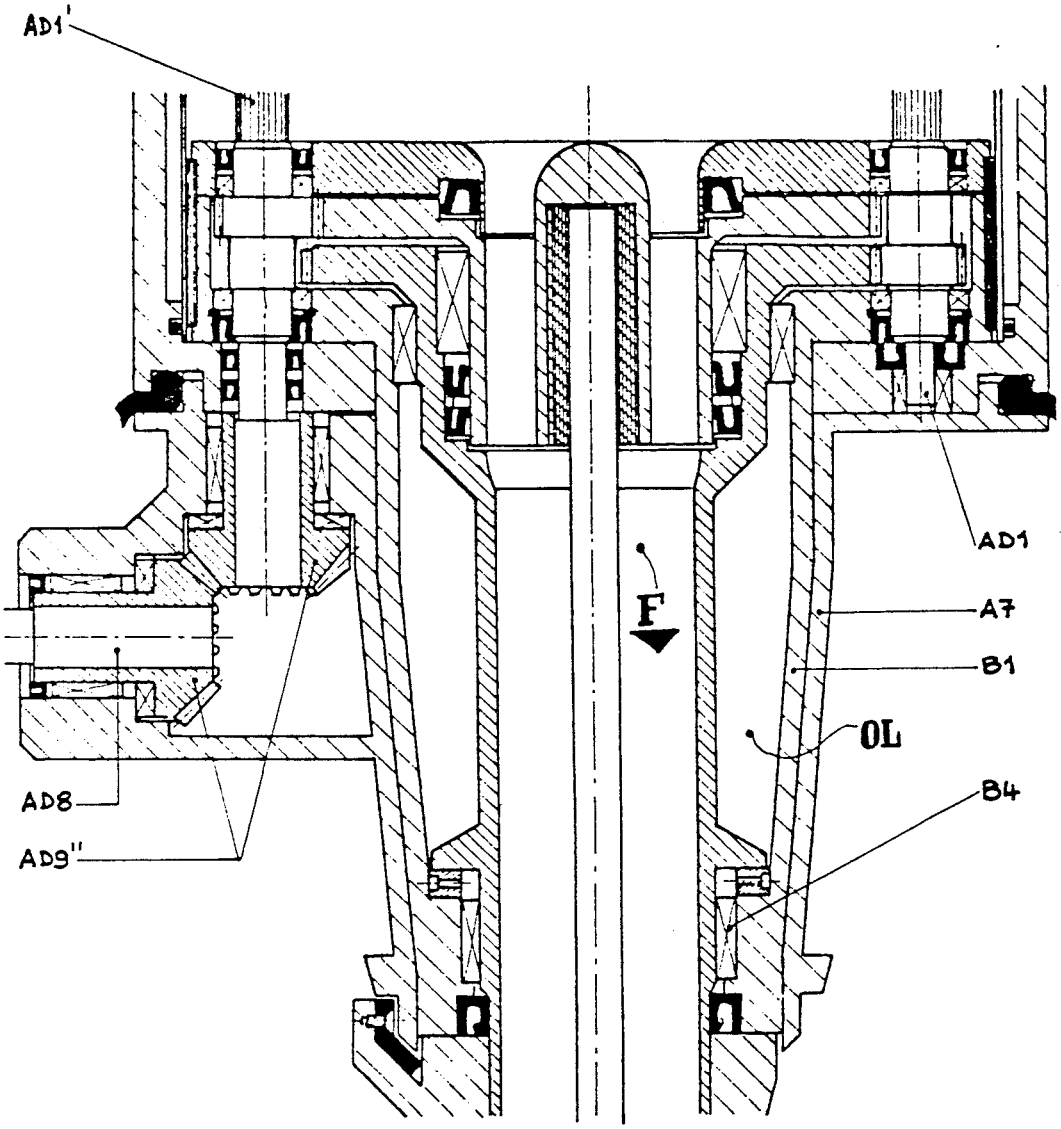
FIG. 6 shows a longitudinal sectional view of one embodiment, different from that in FIGS. 1 to 5, of the propulsor, with the movable part extended.

The assembly illustrated in FIG. 6 differs from the one previously described for the fact that the movement of the shaft AD1 is provided, through the bevel gear pair AD9', with a horizontal transmission shaft AD8 placed under it.

Figure 7:
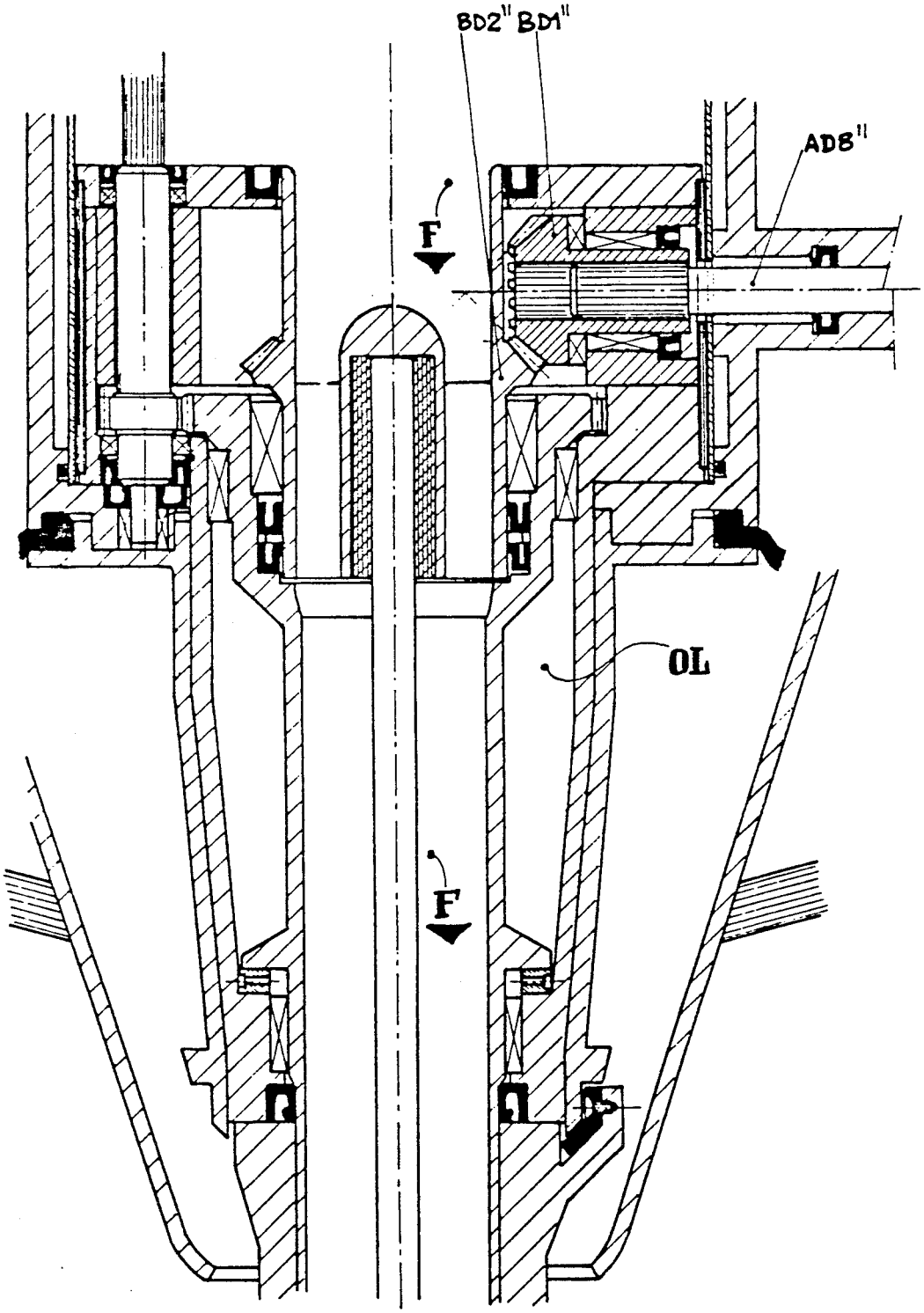
FIG. 7 shows a longitudinal sectional view of one embodiment of the propulsor assembly, different from that in the previous figures, with the movable part extended.

The assembly illustrated in FIG. 7 is distinguished by the fact that the hollow pinion BD1'', engaging the crown gear BD2'', is keyed on a horizontal transmission shaft AD8'' (there is no shaft AD1).

As shown in FIG. 7; AD8'' is retractable past B1 to permit retraction of B1 from the extended position to a point past the casing A2.

Figure 8:
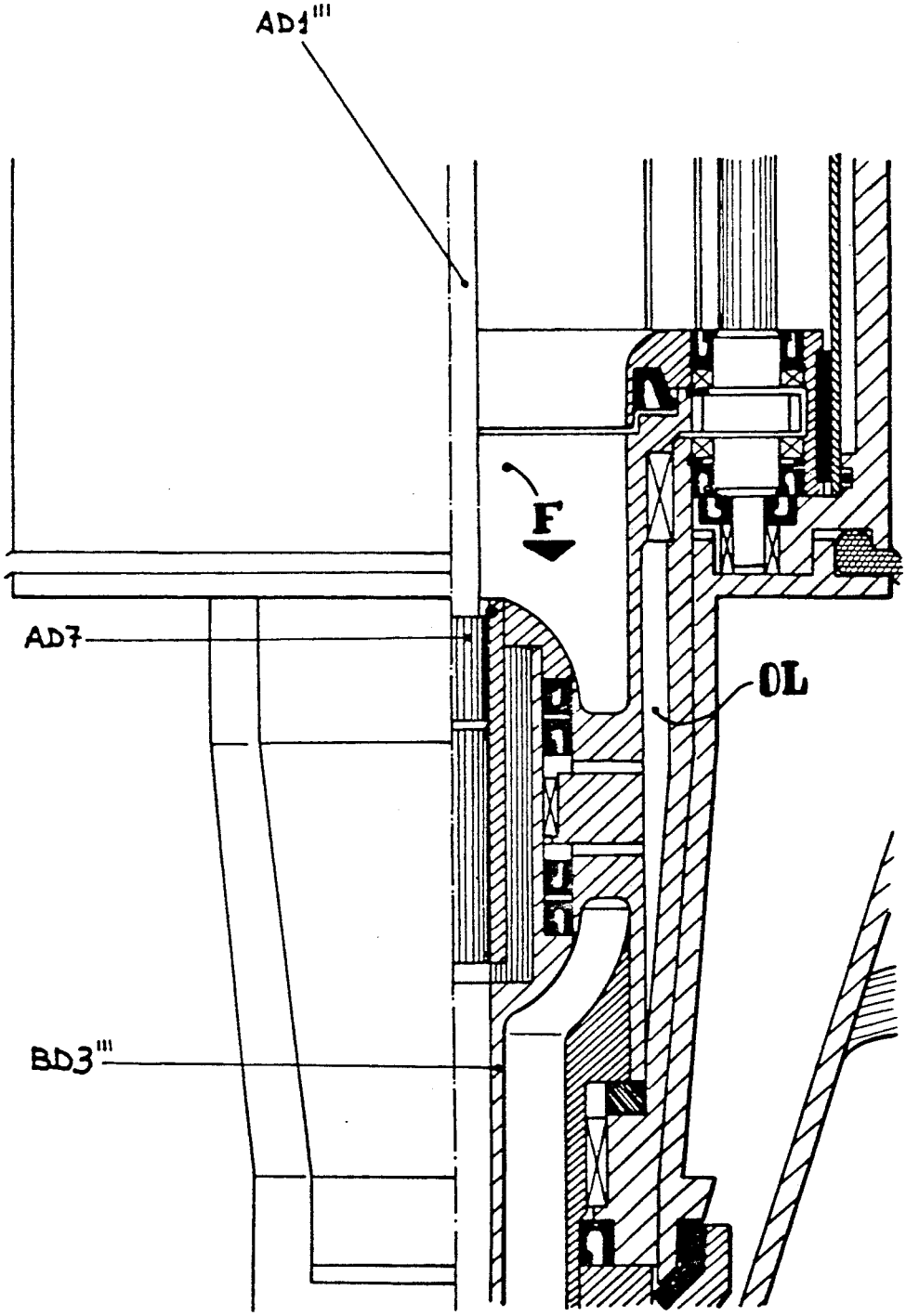
FIGS. 8, 9, 10 show transversal sectional views of various embodiments of a propulsor with the movable part extended.

The assembly illustrated in FIG. 8 is distinguished by the fact that the shaft AD1''', on the end of which a head AD7 is keyed, is axial and the transmission shaft BD3''' of the movement to the propeller is hollow.

Figure 9:
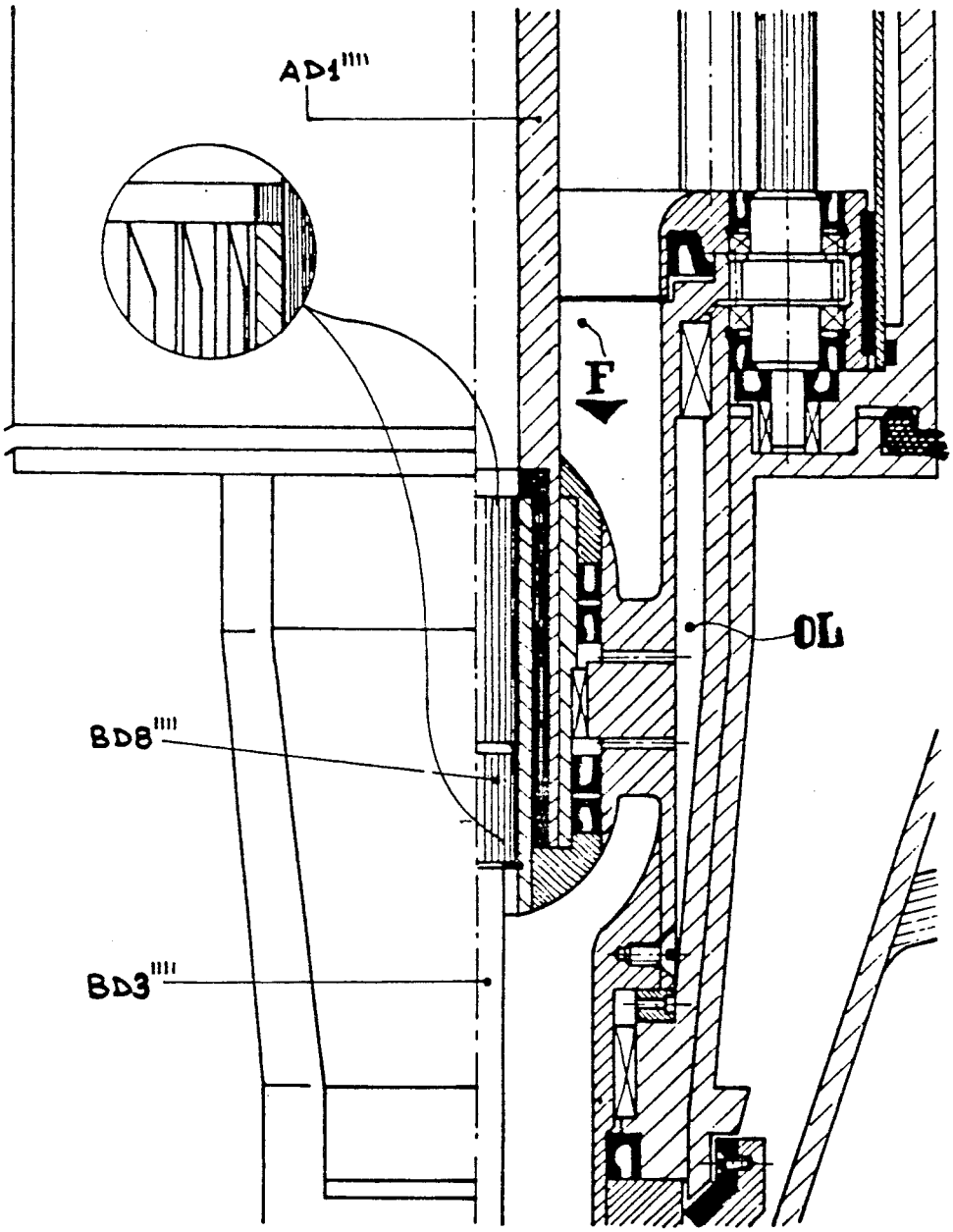

The assembly illustrated in FIG. 9 is distinguished by the fact that the shaft AD1'''' is axial and hollow, while it is the transmission shaft BD3'''' which has a splined head BD8''''.

Figure 10:
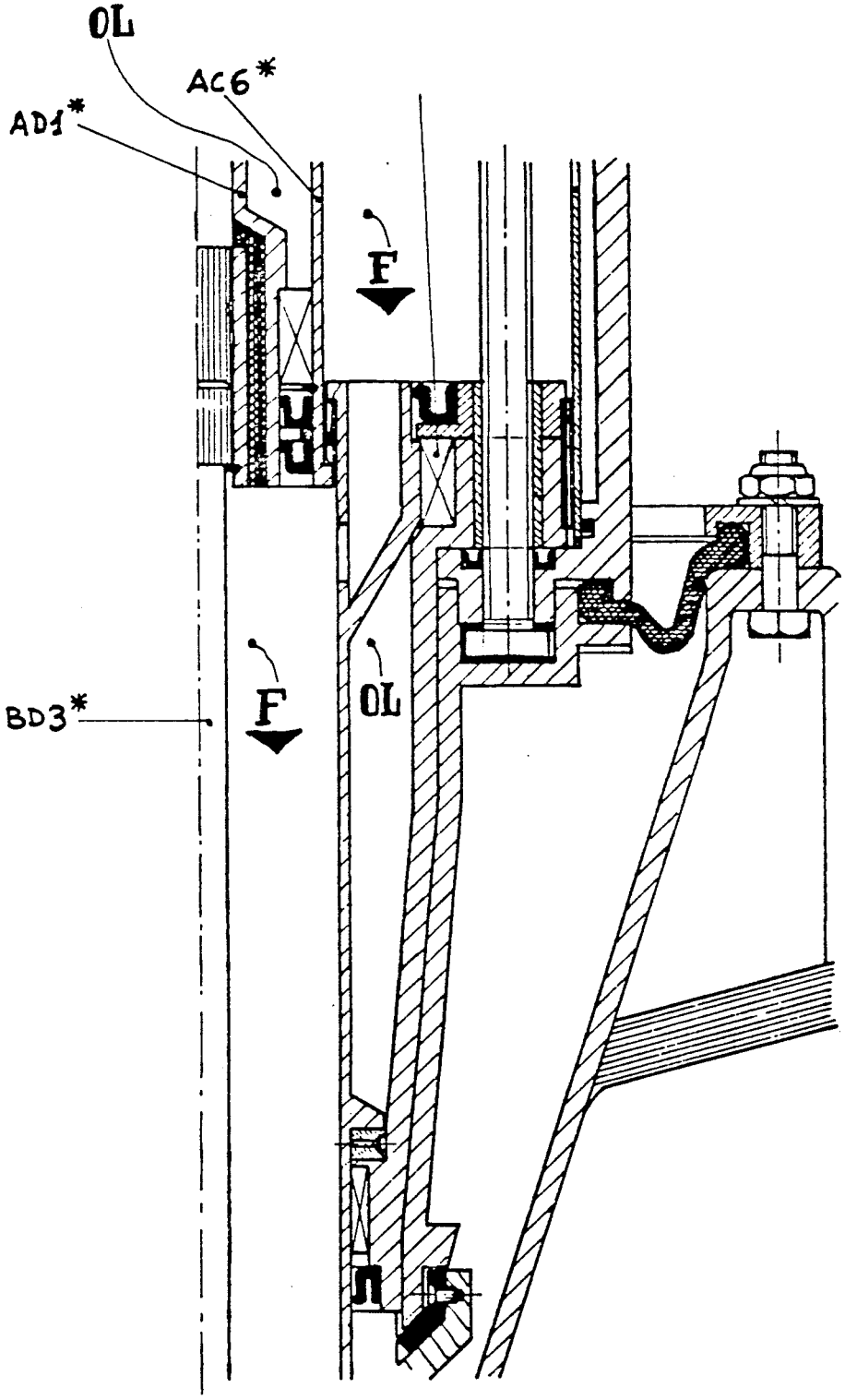

The assembly shown in FIG. 10 is distinguished by the fact that the rotation shaft AC6* is coaxial to the couple of shafts AD1*-BD3*, similar to that in FIG. 9. In this drawing a splined bar AE1 is removed by 45°, to allow its section on a transversal plane.

Figure 11:
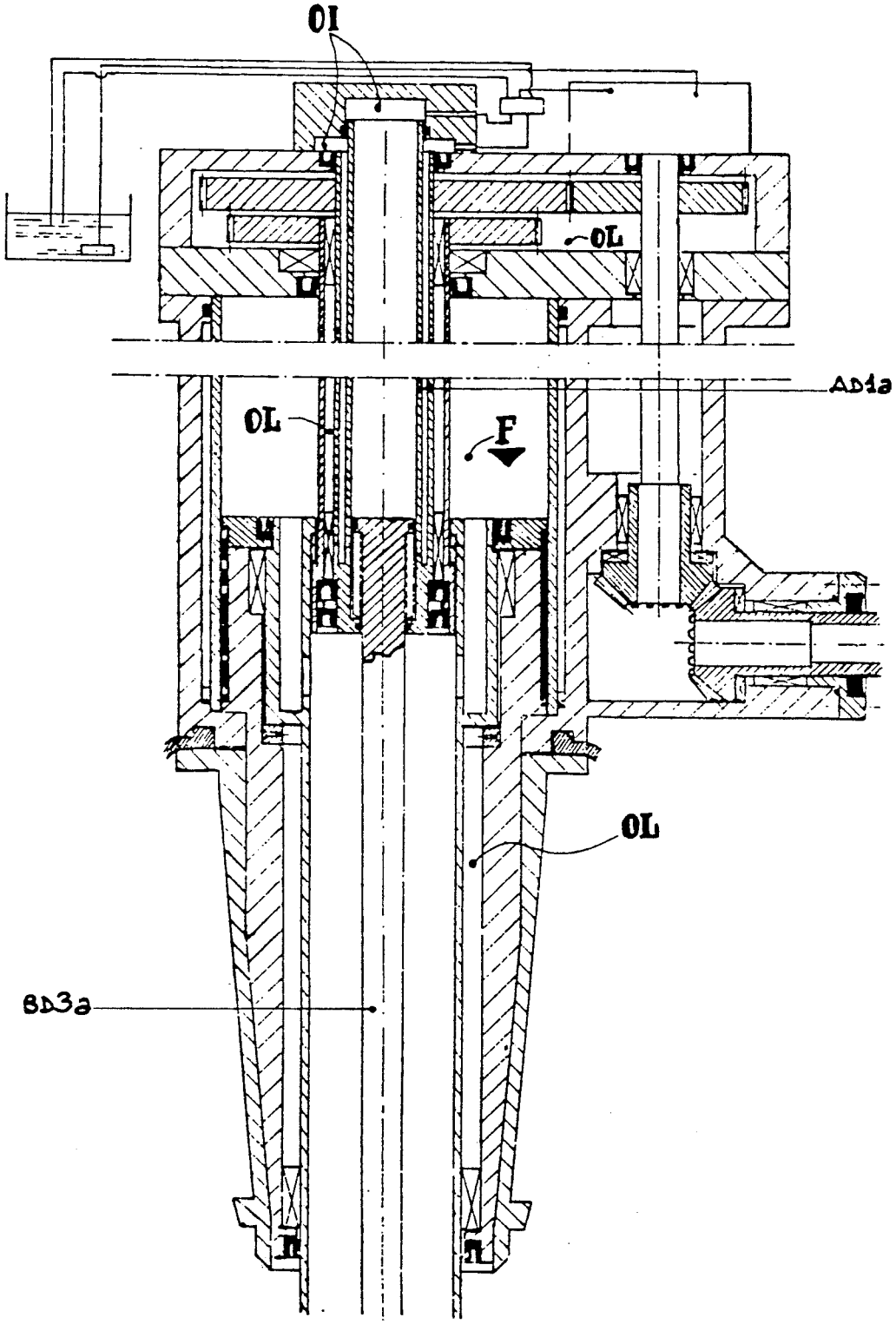
FIGS. 11, 12, 13 show a longitudinal sectional view of embodiments of a propulsor, with a hydraulic translation system, with the movable part extended.
Figure 12:
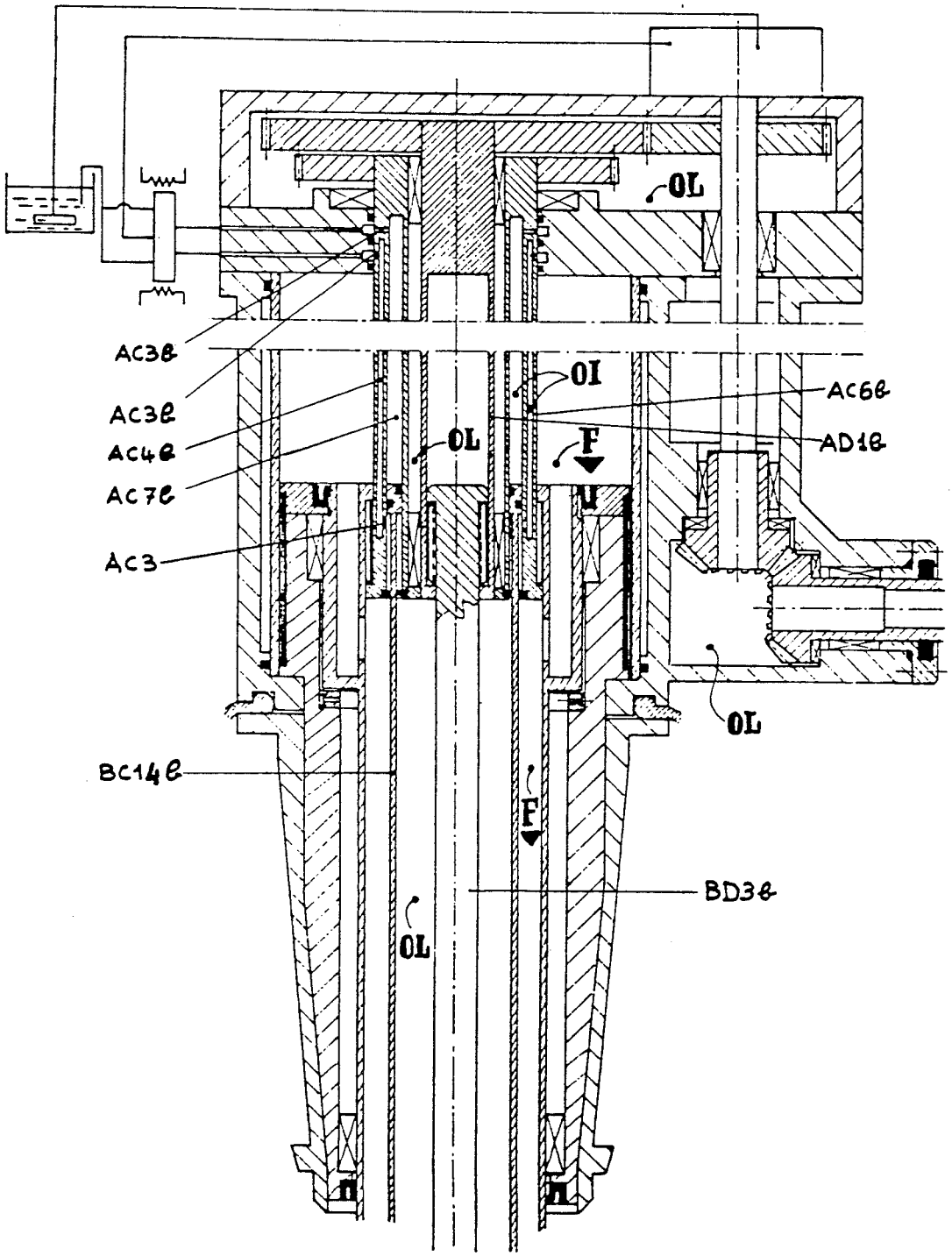
Figure 13:
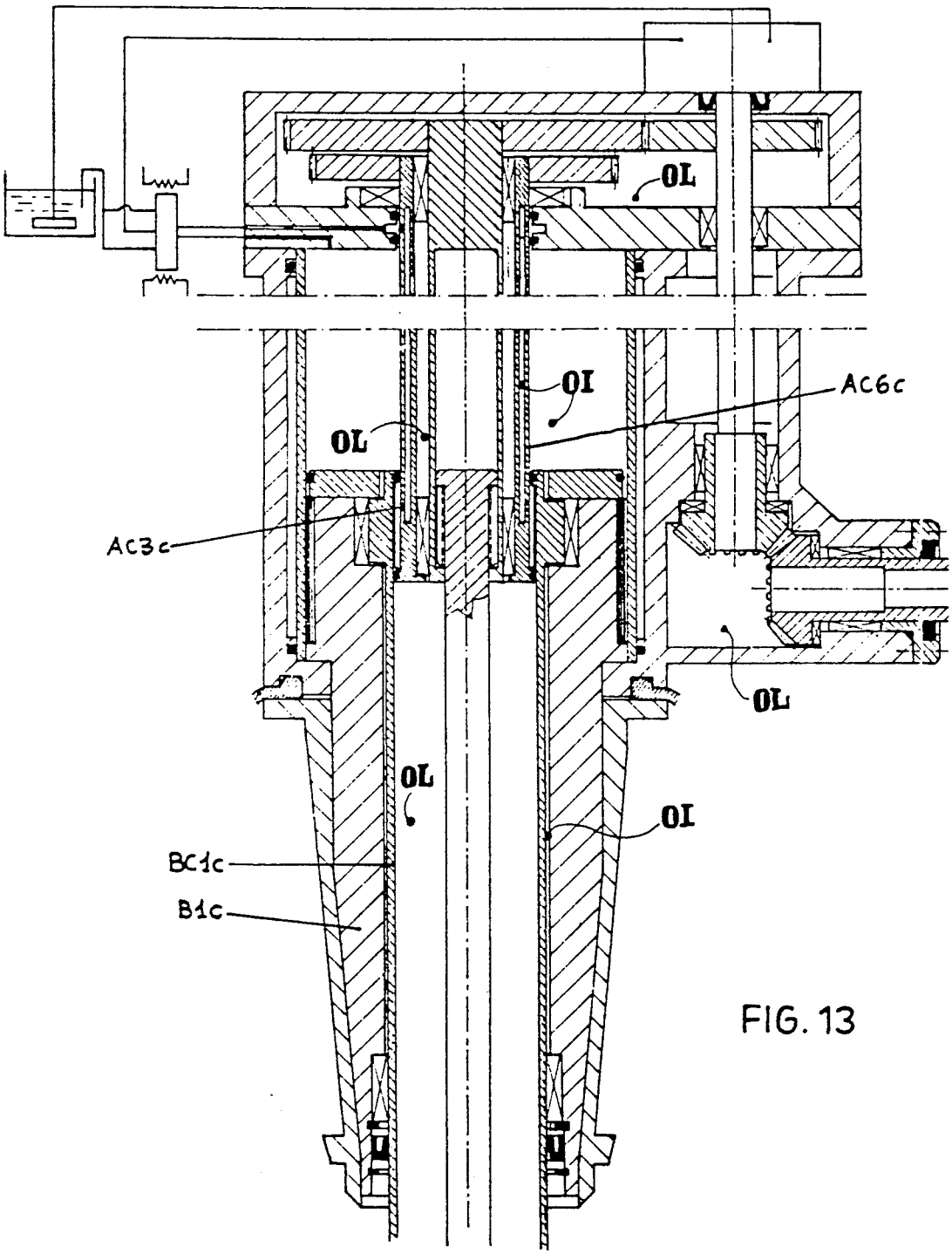

The propulsors, which have been described from the mechanical point of view, can be moved in a vertical direction by a cylinder-piston device. In FIGS. 11, 12 and 13 different ways for carrying out said device are shown in assemblies in which the transmission shaft AD1, rotating shaft AC6 and transmission shaft BD3 are coaxial. In the assembly shown in FIG. 11 the shaft BD3*a* acts as a piston and the transmission shaft AD1*a* as a cylinder, in order to carry out a hydraulic jack. In the assembly shown in FIG. 12 a tubular element BC14*b* integral to the bottom end of the propeller acts as a piston and a chamber AC7*b* in the shaft AC6*b* acts as a cylinder. In this drawing a coaxial duct AC4*b* for the hydraulic oil and holes AC3*b* for the passage of the oil can be seen. In the assembly shown in FIG. 13, at the end, in the downwards thrust the carriage B1*c* and the air space between the shaft AC6*b* and the cylindric element A2*c* respectively act as piston and cylinder, while in the ascent the shaft AC6*c* acts as a piston and the inner part of the hollow shaft BD1*c* as a cylinder.

In the attached drawings, in order to understand the operation of the hydraulic jack the lubrication oil between the various elements and the hydraulic oil are respectively marked with OL and OI.

The engine exhaust fumes which go through the appropriate hollow parts inside the assembly are marked with F, the outlet of said fumes from the tubing cylinder BC7 of the propeller BD15 being provided in the propulsors illustrated.

Figure 17:
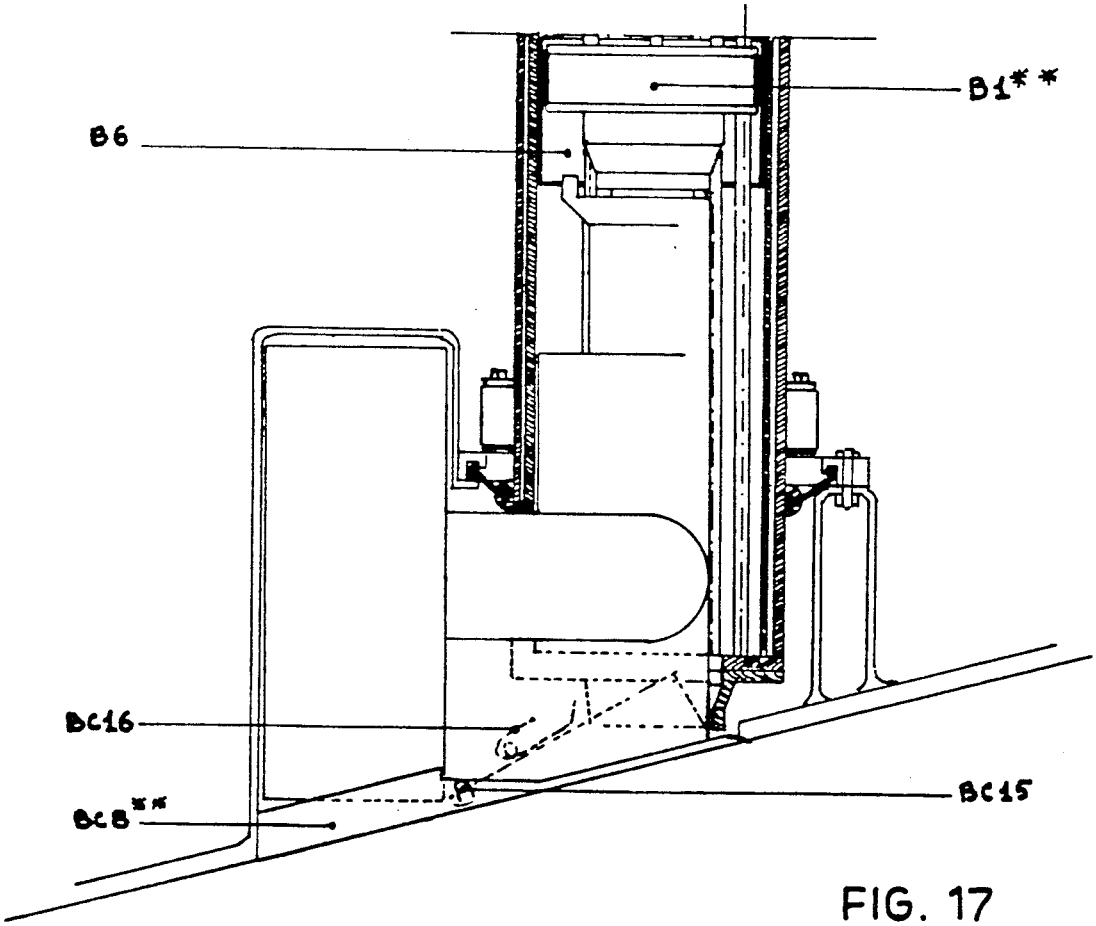
FIG. 17 shows a partially sectioned, longitudinal view of the assembly of FIG. 16 with the movable part retracted.
Figure 16:
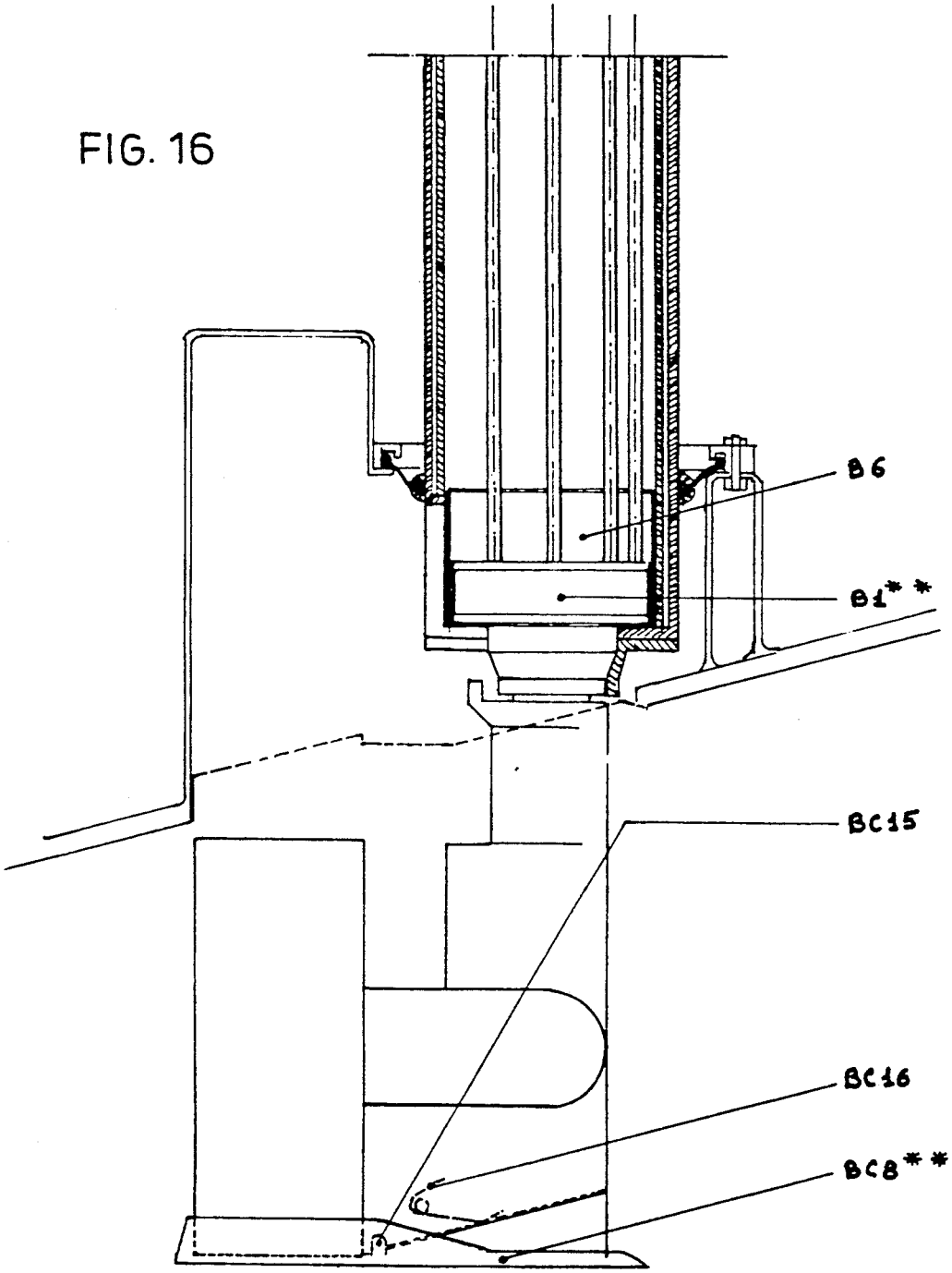
FIG. 16 shows a partially sectioned, longitudinal view of a further embodiment of a propulsor with the movable part extended.

In FIGS. 16 and 17 a propulsor is shown which is distinguished from the ones previously described by the fact that the closing door BC8 is hinged, by a pivot BC15, and subjected to the effect of a spring BC16. When the assembly is extended the door BC8 is held horizontally by the spring BC16, while when the assembly is retracted, due to the compression of the spring, it can rotate in order to restore the exact shaft of the hull. The propulsor also has a carriage B1 of a reduced size which does not cover the opening of the tube when the assembly is extended; in order to avoid that the fumes pass through said opening of the tube and are discharged in the boss, the hollow cylinder B6 is used which can slide and is provided with overhanging flanges towards the inside of its upper and lower ends. The carriage B1 runs on the inside of this cylinder B6 and during the ascent knocks the upper flange and takes a rest position (FIG. 17), while during the descent knocks on the lower flange and takes the position in which it closes the opening of the tube (FIG. 16).

I claim:

1. A propulsor for boats comprising a fixed tubular part (A2, A5, A7), adapted to be mounted on a boat having an engine, a main transmission (AD4, AD1, BD1, BD2) from said engine to a substantially vertical transmission shaft (BD3), which operates a bevel gear pair (BD12-BD13), on a substantially horizontal outlet (BD14) on which a propeller (BD15) is mounted, an auxiliary transmission for angular adjustment of said bevel gear pair and the propeller around a vertical axis, a movable assembly (BC1, BC5, B1) which is vertically movable with respect to said fixed tubular part and carries said bevel gear pair (BD12, BD13) and said inner propeller (BD15), said movable assembly comprising an inner part (BC1, BC5) and a carriage (B1), said inner part being angularly adjustable around a vertical axis and supported on said carriage (B1), said carriage being vertically movable with respect to said fixed part (A2, A5, A7) between an extended and a retracted position and having a lower downwardly extending end, said main transmission including a lateral pinion (BD1") meshing with a crown gear (BD2") which is integral with said main transmission shaft (BD3), said pinion (BD1") having a horizontal axis, and a driving shaft that has a horizontal axis (AC8").

wherein said pinion (B1") has a hollow splined recess and the horizontal shaft has a splined end and is shiftable between a retracted position, in which it does not engage the pinion, and an extended position, in which it drivingly engages the pinion, the retracted position permitting a retracted position of said movable assembly.

2. A propulsor for boats comprising a fixed tubular part (A2, A5, A7), adapted to be mounted on a boat having an engine, a main transmission (AD4, AD1, BD1, BD2) from said engine to a substantially vertical transmission shaft (BD3), which operates a bevel gear pair (BD12-BD13), on a substantially horizontal outlet (BD14) on which a propeller (BD15) is mounted, an auxiliary transmission for angular adjustment of said bevel gear pair and the propeller around a vertical axis, a movable assembly (BC1, BC5, B1) which is vertically movable with respect to said fixed tubular part and carries said bevel gear pair (BD12, BD13) and said propeller (BD15), said movable assembly comprising an inner part (BC1, BC5) and a carriage (B1), said inner part being angularly adjustable around a vertical axis and supported on said carriage (B1), said carriage being vertically movable with respect to said fixed part (A2, A5, A7) between an extended and a retracted position and having a lower downwardly extending end, wherein said fixed part and said movable assembly have inner cavities (BC1, BC5, B1), for the passage of engine exhaust fumes.

3. A propulsor for boats comprising a fixed tubular part (A2, A5, A7), adapted to be mounted on a boat having an engine, a main transmission (AD4, AD1, BD1, BD2) from said engine to a substantially vertical transmission shaft (BD3), which operates a bevel gear pair (BD12-BD13), on a substantially horizontal outlet (BD14) on which a propeller (BD15) is mounted, an auxiliary transmission for angular adjustment of said bevel gear pair and the propeller around a vertical axis, a movable assembly (BC1, BC5, B1) which is vertically movable with respect to said fixed tubular part and carries said bevel gear pair (BD12, BD13) and said propeller (BD15), said movable assembly comprising an inner part (BC1, BC5) and a carriage (B1), said inner part being angularly adjustable around a vertical axis and supported on said carriage (B1), said carriage being vertically movable with respect to said fixed part (A3, A5, A7) between an extended and a retracted position and having a lower downwardly extending end, the propeller being contained in a tubular cylinder (BC7) provided with a door (BC8) which acts as a closing door in the retracted position of the assembly, wherein said door (BC8) is hinged by a pivot (BC15), and subjected to the effect of a spring (BC16) to urge it closed.

* * * * *